US010123934B2

(12) United States Patent
Derwin et al.

(10) Patent No.: US 10,123,934 B2
(45) Date of Patent: Nov. 13, 2018

(54) CLITORAL STIMULATOR

(71) Applicant: 7417986 Manitoba Inc., Winnipeg (CA)

(72) Inventors: Melanie Derwin, Winnipeg (CA); Kyle R. Satterthwaite, Winnipeg (CA)

( * ) Notice: Subject to any disclaimer, the term of this patent is extended or adjusted under 35 U.S.C. 154(b) by 118 days.

(21) Appl. No.: 15/287,041

(22) Filed: Oct. 6, 2016

(65) Prior Publication Data

US 2017/0105896 A1 Apr. 20, 2017

Related U.S. Application Data

(60) Provisional application No. 62/243,828, filed on Oct. 20, 2015.

(51) Int. Cl.
*A61H 19/00* (2006.01)
*A61H 7/00* (2006.01)

(52) U.S. Cl.
CPC ..... *A61H 19/34* (2013.01); *A61H 7/005* (2013.01); *A61H 2201/0153* (2013.01); *A61H 2201/1215* (2013.01); *A61H 2201/149* (2013.01); *A61H 2201/1418* (2013.01); *A61H 2201/1463* (2013.01); *A61H 2201/1635* (2013.01); *A61H 2201/1638* (2013.01); *A61H 2201/1645* (2013.01); *A61H 2201/1664* (2013.01)

(58) Field of Classification Search
CPC ..... A61H 19/34; A61H 19/44; A61H 23/02; A61H 2201/1635; A61H 2201/1664; A61H 2205/086
USPC ..... 600/38–41
See application file for complete search history.

(56) References Cited

U.S. PATENT DOCUMENTS 912,708 A * 2/1909 Midgley ..... A61H 31/008 601/97
2,138,815 A * 12/1938 Eberly ..... A61H 23/0254 601/103
5,081,985 A * 1/1992 Borodulin ..... A61H 21/00 601/1
6,422,993 B1 * 7/2002 Hudson ..... A61H 19/34 600/38
8,206,328 B2 * 6/2012 Adamson ..... A61H 7/007 601/133

* cited by examiner

*Primary Examiner* — Samuel Gilbert
(74) *Attorney, Agent, or Firm* — Kyle R Satterthwaite; Ryan W Dupuis; Ade & Company Inc.

(57) ABSTRACT

A clitoral stimulator features first and second contact members, at least one of which is supported for back and forth movement relative to the other of said first and second contact members in a longitudinal direction. Each contact member has a respective contact surface on side thereof facing toward the other in a lateral direction lying transverse to the longitudinal direction. The respective contact surfaces are separated or separable by a sufficient distance to accommodate a user's clitoris between the respective contact surfaces of said first and second contact members with said respective contact surfaces in contact with the user's clitoris at opposing sides thereof. An actuation mechanism is operable to drive the back and forth movement to perform a rolling action the user's clitoris between the stimulation members.

8 Claims, 3 Drawing Sheets

CLITORAL STIMULATOR

CROSS REFERENCE TO RELATED APPLICATIONS

This application claims benefit under 35 U.S.C. 119(e) of Provisional Application Ser. No. 62/243,828, filed Oct. 20, 2015, the entirety of which is incorporated herein by reference.

FIELD OF THE INVENTION

The present invention relates generally to devices or aids for female sexual gratification, and more specifically to a device providing clitoral stimulation by using relative movement between contact surfaces on either side of the clitoris to induce a rolling effect thereon.

BACKGROUND

Conventional products for stimulating the clitoris typically rely on vibrational motion to do so. Applicant has conceived of a new device with a unique structure and function to impart stimulation to the clitoris in non-vibrational way that was previously achievable only through manual technique, and could not be performed with conventional toys or aids that typically rely on vaginal penetration and/or vibrational clitoral stimulation. The disclosed invention thereby provides a unique alternative to commercially available products.

SUMMARY OF THE INVENTION

According to one aspect of the invention there is provided a clitoral stimulator comprising:

first and second contact members, of which at least one of said first and second contact members is supported for back and forth movement relative to the other of said first and second contact members in a longitudinal direction, and each of which comprises a respective contact surface on side thereof facing toward the other in a lateral direction lying transverse to the longitudinal direction, the respective contact surfaces being separated or separable by a sufficient distance to accommodate a user's clitoris between the respective contact surfaces of said first and second contact members with said respective contact surfaces in contact with the user's clitoris at opposing sides thereof; and an actuation mechanism coupled to said at least one of said first and second contact members and operable to drive said back and forth movement thereof;

whereby with the user's clitoris received between, and in contact with, the respective contact surfaces of said first and second contact members, activation of the actuation mechanism rolls the user's clitoris between the stimulation members.

In one embodiment, both of the first and second contact members are supported for back and forth movement in the longitudinal direction and the actuation mechanism is configured to drive the first and second contact members in opposing directions in the longitudinal direction.

In one embodiment, each stimulation member comprises an elongated finger.

In one embodiment, the contact members are shaped to leave a gap between the contact members that is of greater width than the distance between the contact surfaces at an area located intermediately between the contact surfaces and a drive end of the contact members from which the contact members are driven by the actuation mechanism.

In one embodiment, an inner side of said one or both of the contact members at which the respective contact surface is disposed is concavely curved at the area located intermediately between the contact surfaces and the drive end of the contact members.

In one embodiment, the contact members comprise a curvier one of said contact members that has a greater curvature at the inner side thereof than a less curvy one of said contact members.

In one embodiment, an exterior of each contact member is resiliently flexible, at least at the contact surface thereof.

In one embodiment, the contact members, in shape, visually resemble a pinched together thumb and finger.

In one embodiment, the actuation mechanism comprises a respective reciprocating drive for the first contact member, said respective reciprocating drive for the first contact member comprising a rigid base of said first contact member and a guide constraining said rigid base to a predetermined path along the longitudinal direction.

In one embodiment, the actuation mechanism comprises a respective reciprocating drive for the second contact member, said respective reciprocating drive for the second contact member comprising a second rigid base of said second contact member and a guide constraining said rigid base of said second contact member to a predetermined path along the longitudinal direction.

In one embodiment, the actuation mechanism comprises a respective driven wheel and respective connecting rod for the first contact member, the respective driven wheel for the first contact member is rotatable on a rotation axis that is transverse to the longitudinal direction, the respective connecting rod for the first contact member has a first pivotal connection to the respective driven wheel for the first contact member at an eccentric point thereon and a second pivotal connection to the first contact member, and the first and second pivotal connections of the respective connecting rod for the first contact member have parallel pivot axes that lie transverse to the longitudinal direction.

In one embodiment, the actuation mechanism comprises a respective driven wheel and respective connecting rod for the second contact member, the respective driven wheel for the second contact member is rotatable on a second axis that is parallel to the rotation axis of the respective driven wheel for the first contact member, the respective connecting rod for the second contact member has a third pivotal connection to the respective driven wheel for the second contact member at an eccentric point thereon and a fourth pivotal connection to the second contact member, and the second and third pivotal connections of the respective connecting rod for the first contact member have third and fourth pivot axes that lie parallel to the pivot axes of the first and second pivotal connections.

In one embodiment, the first and third pivotal connections reside diametrically opposite one another on the respective driven wheels.

In one embodiment, the actuation mechanism comprises a singular motor arranged to drive both of the first and second contact members.

In one embodiment, the actuation mechanism comprises a singular motor arranged to drive both of the first and second contact members, and each driven wheel is a geared drive wheel forming part of a gear train by which the singular motor drives both the first and second contact members.

In one embodiment, the actuation mechanism is contained at least partly within a housing and the contact surfaces of the contact members reside externally of said housing beyond an open end of said housing, away from which the contact members extend toward said contact surfaces in the longitudinal direction.

In one embodiment, the housing comprises a finger receptacle at a topside thereof for wearing of the clitoral stimulator on a user's finger.

In one embodiment, the actuation mechanism comprises one or more controls situated externally of the housing at the topside thereof at a location that is finger-tip accessible from the finger receptacle.

In one embodiment, the finger receptacle is open ended and the one or more controls are located between the finger receptacle and the open end of the housing in the longitudinal direction.

BRIEF DESCRIPTION OF THE DRAWINGS

One Preferred embodiments of the invention will now be described in conjunction with the accompanying drawings in which.

In the drawings like characters of reference indicate corresponding parts in the different figures.

DETAILED DESCRIPTION

Figure 1:
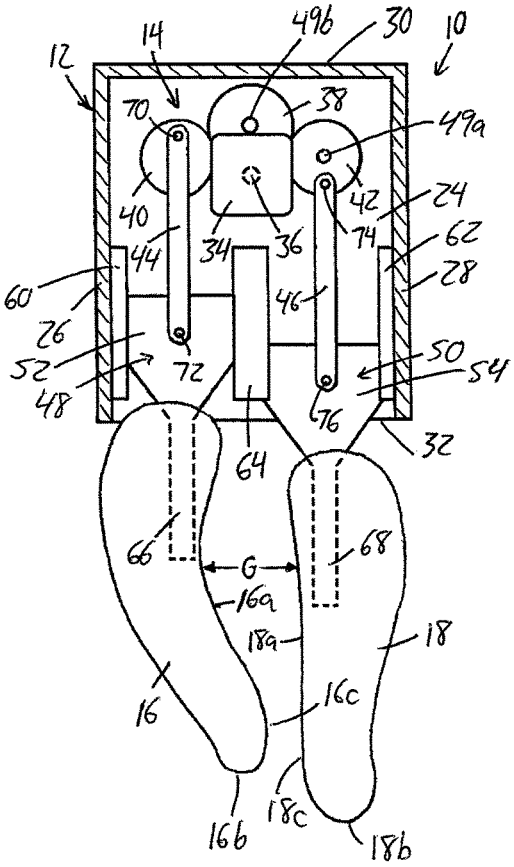
FIG. 1 is a cross-sectional view of a clitoral stimulator according to a first embodiment of the present invention, as viewed along line A-A of FIG. 3.

The drawings illustrate a clitoral stimulation device 10 that uses relative movement between two contact members to impart a rolling motion to the clitoris of a user. The device 10 features a housing 12, an actuation mechanism 14, and first and second finger-like contact members 16, 18 movably supported in the housing and driven by the actuation mechanism 14. The contact members may be removable to enable washing, replacement with a new pair of contact members, or substitution of different configured contact members of different shape, material, etc. For example, a set of round ball-like members may be interchangeable for the elongated finger-like members shown in the drawings. The housing features opposing top and bottom walls 20, 24, a pair of opposing side walls 26, 28, and an end wall 30 denoting a closed end of the housing, which lies opposite to an open end 32 thereof. The walls collectively delimit an interior space of the housing in which the actuation mechanism is contained and the contact members 16, 18 are supported. The contact members 16, 18 reside entirely (or nearly entirely) outside the housing and connect to the actuation mechanism via the open end 32 of the housing. The ends 30, 32 of the housing are spaced apart in a longitudinal direction in which the side walls extend. The side walls 26, 28 are spaced apart in a lateral direction that is perpendicularly transverse to the longitudinal direction, and the top and bottom walls 20, 24 are spaced apart in a thickness direction that is perpendicularly transverse to both the longitudinal and lateral directions.

Inside the housing 12, the actuation mechanism features a single electric motor 34, and an associated gear train driven thereby, near the end wall 30 of the housing. The shaft 36 of the motor carries an input gear (not visible in the illustrated views) of the gear train, which additionally features an intermediate gear 38 that intermeshes with two gear-toothed drive wheels 40, 42 that define two outputs of the gear train. In the illustrated embodiment, the drive wheels and intermediate gear are rotatably supported on the bottom wall 24 of the housing by stub shafts 49*a*, 49*b* standing upward therefrom. Each drive wheel 40, 42 is operable to drive movement of a respective one of the two contact members 16, 18. To accomplish this, a respective connecting rod 44, 46 has one end pivotally pinned or journaled to each drive wheel 40, 42 at an eccentric point situated radially outward from the rotational axis of the drive wheel 44, as defined by the respective stub shaft 49*a*. The other end of each connecting rod 44, 46 is pivotally pinned or journaled to a rigid frame or carrier 48, 50 that carries a respective one of the contact members 16, 18. Each rigid carrier 48, 50 features a slide body 52, 54 engaged within a respective pair of guide channels that lie longitudinally of the housing within the interior space thereof between the gear train and the open end of the housing. In the illustrated embodiment, two outer guide tracks 60, 62 are respectively mounted to the side walls 26, 28 of the housing 12 and each have a respectively inward-facing guide channel that slidably receives the outer side of one of the slide bodies 52, 54. A singular center track 64 is affixed to the bottom wall 24 of the housing and has two guide channels on its opposing sides for receiving the inner sides of the two slide bodies 52, 54. The three tracks thus define four guide channels that constrain movement of the rigid carriers to linear movement in the longitudinal direction. In other embodiments, a singular center track defining two guide channels on its opposing sides may be replaced with two discrete tracks, each defining the inner guide channel for one of the slide bodies.

Each rigid carrier 48, 50 reaches out from between the respective pair of guide channels toward and through the open end 32 of the housing. As shown, each rigid carrier may narrow in this outward longitudinal direction reaching through the open end of the housing, whereby the slide body 52, 54 of each rigid carrier 48, 50 is of greater width than a longitudinal extension 66, 68 of the rigid carrier that reaches longitudinally outward from the slide body to carry the respective contact member 16, 18 outside the housing 12. Each contact member is an elongated finger-like body of resiliently pliable material in which the longitudinal extension 66, 68 of the respective rigid carrier 48, 50 is embedded at a drive end of the contact member. Examples of materials that may be employed include silicone, latex rubber, and elastomers. Each contact member 16, 18 reaches longitudinally outward from the end of the longitudinal extension 66, 68 of the respective rigid carrier 48, 50 before terminating at a distal end 16*a*, 18*a*. The first contact member 16 is curvier than the second contact member 18, particularly at an inner side 16*b* of the first contact member that faces toward the second contact member in the lateral direction. The inner side 16*b* has a concave curvature by which the first contact member gradually reaches closer to the second contact member toward the distal end 16*a* of the first contact member. A gap G between the two contact members 16, 18 in the lateral direction thus grows smaller moving toward the distal ends 16*a*, 18*a* of the two contact members. An inner side 18*a* of the second contact member that faces laterally toward the inner side 16*a* of the first contact member is less curved than the inner side of the first contact member, and instead lies more in-line with the longitudinal direction in which the contact members are linearly reciprocated by the actuation mechanism.

Each contact member has a respective contact surface 16*c*, 18*c* situated at the inner side 16*a*, 18*a* thereof near the distal end 16*b*, 18*b* of the contact member. As shown, the inner side 16*a* of the first contact member may transition from concave to convex at the contact surface 16*c*, 18*c*. The contact surfaces 16*c*, 18*c* are separated or separable from one another by a suitable distance to accommodate the user's clitoris therebetween such that opposing sides of the clitoris are respectively contacted by the two contact surfaces. The illustrated embodiment shows the two contact surfaces as naturally residing in a separated condition. In other embodiments, one or both of the contact members may be resiliently biased into gentle contact with the other at the contact surfaces, but can be manually pulled apart to accommodate the clitoris therebetween. As opposed to flexing of the overall longitudinal shape of the contact member(s), the resiliency of the contact member may be such that only localized surface depression of the exterior surface material of the contact member(s) at the contact surface(s) thereof is used to accommodate the clitoris therebetween. Accordingly, the contact members need not necessarily consist solely of resilient, flexible material throughout, and may for example comprise an internal core of harder material than one or more flexible exterior layers that are resiliently compressible to accommodate receipt of the user's clitoris. As another alternative to resilient biasing of the contact members toward one another, the contact members may be made of pliable/bendable but shape-retaining material that can be bent or manipulated into varying shapes to achieve a user-specified spacing apart of the contact surfaces to accommodate the clitoral size and comfort of a particular user.

Figure 2:
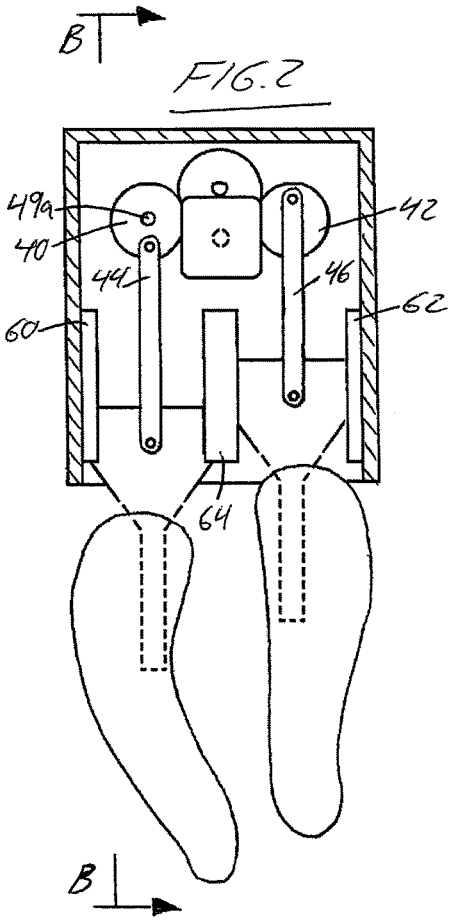
FIG. 2 is a cross-sectional view of the clitoral stimulator of FIG. 1, as viewed in the same plane, but with movable contact members of the stimulator in a different relative position to one another.
Figure 5:
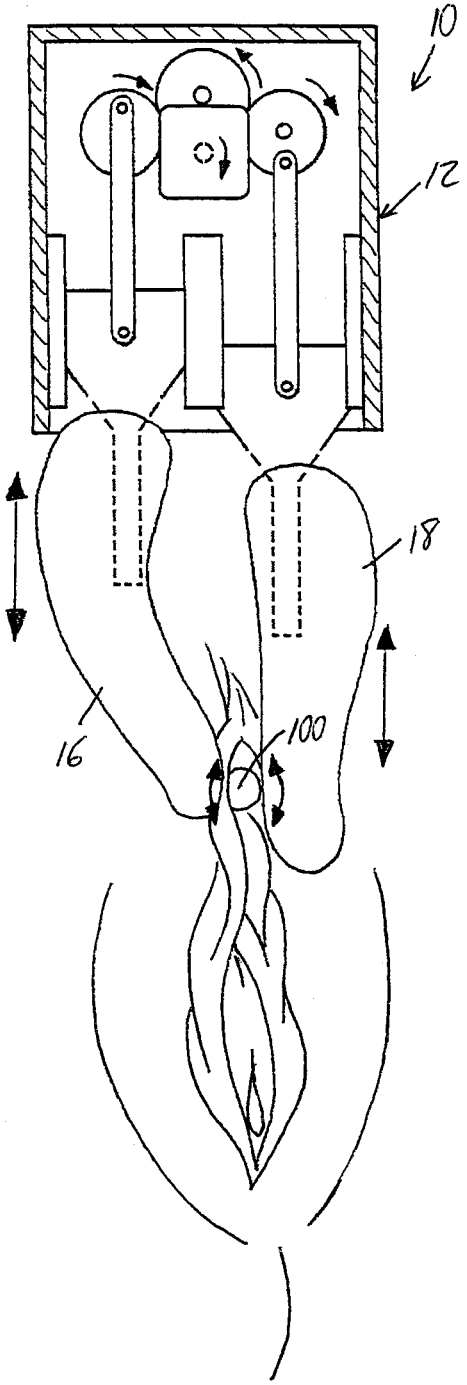
FIG. 5 schematically illustrates use of the clitoral stimulator of FIG. 1 to impart a rolling action on the clitoris through relative movement of the contact members on opposing sides thereof.

The rotational axes of the motor 34, input gear, intermediate gear 38 and gear-toothed drive wheels 40, 42, along with the pivot axes of the pivotal connections 70, 72, 74, 76 of the connecting rods to the drive wheels 40, 42 and the rigid carriers 50, 52, all lie parallel to one another in the thickness direction, whereby operation of the motor 34 will drive reciprocation of each contact member 16, 18 in the longitudinal direction. As shown in FIGS. 1 and 2, the pivotal connections 70, 72 of the connecting rods to the drive wheels 40, 42 reside diametrically opposite one another, such that when one of these pivotal connections resides nearest to the closed end of the housing, the other pivotal connection resides nearest to the open end 32 of the housing. Accordingly, the two contact members 16, 18 always move in opposing directions to one another, i.e. when one contact member is retracting longitudinally inwardly toward the housing interior, the other contact member is being extended longitudinally outwardly away from the housing interior. Accordingly, the two contact members move oppositely of one another in the longitudinal direction. With reference to FIG. 5, when the clitoris 100 of the user is received between the contact surfaces of the two contact members, activation of the motor imparts a rolling motion to the clitoris about an axis that lies in the thickness direction of the housing.

Figure 3:
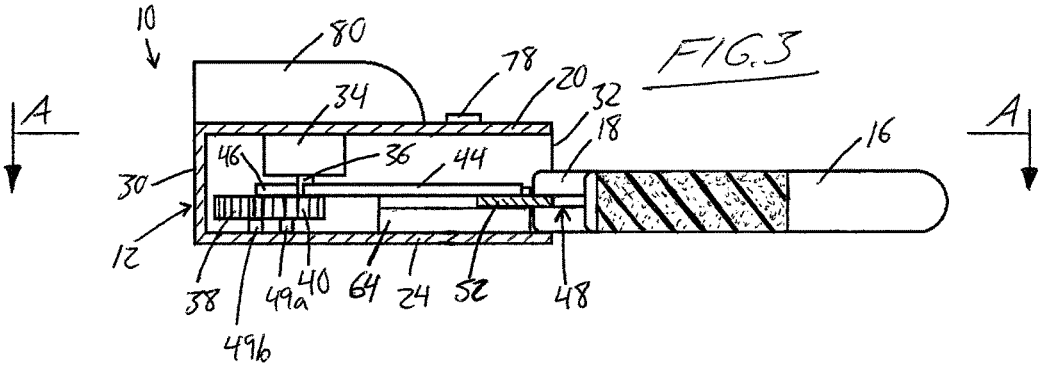
FIG. 3 is a cross-sectional view of the clitoral stimulator of FIG. 2, as viewed along line B-B thereof.
Figure 4:
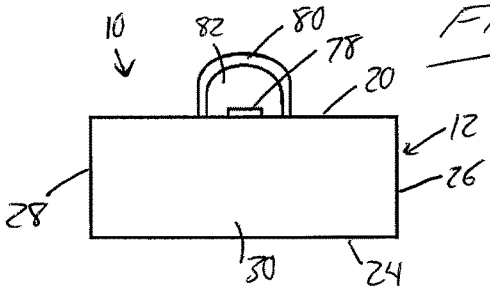
FIG. 4 is an end view of the clitoral stimulator of FIG. 1.

With reference to FIGS. 3 and 4, one or more controls (e.g. pushbuttons) are provided on the housing exterior and wired to the motor and power supply in order to control activation and deactivation thereof, and possibly also provide speed control thereover. The illustrated embodiment shows a single control button 78, which may be operable to control just the on/off state of the motor, or control both the on/off state and operational speed of the motor, for example with a first button press switching the motor on, one or more intermediate button presses then switching from one predetermined speed setting to another, and a final button press switching the motor off. Motor control schemes and suitable control circuitry for same are well known in the art, and thus not described herein in further detail. Other embodiments may employ multiple buttons for controlling different operational states. The power supply (not shown) may be one or more batteries contained within the housing, for example one or more removable batteries, rechargeable or otherwise, or a permanent or semi-permanent rechargeable battery that is not intended for regular removal or replacement, but rather is charged inside the housing 12 via a suitable charging port provided in a wall of the housing (e.g. a USB port for charging from a USB cable).

A finger receptacle 80 is externally attached to the housing at the top wall 20 thereof in the form of a shroud or hood having an axial passage 82 extending fully therethrough in the longitudinal direction. The passage 82 is sized to accommodate passage of a user's finger (e.g. index finger) therethrough so that the shroud or hood passes laterally overtop of the user's finger in order to effectively strap the device to the user in a finger-worn position. The user inserts their finger into the finger receptacle 80 from the open end thereof nearest the closed end of the housing 12, and with the opposite end of the receptacles passage 82 also being open, the user's fingertip projects out from the receptacle to a location overlying the one or more controls 78, which are positioned to reside between the open end 32 of the housing 32 and the nearest open end of the finger receptacle 80. The user can thus support and control the device with only one hand. However, it will be appreciated that the other support features and control layouts may alternatively be employed without detracting from the clitoral stimulation function of the device.

Figure 6:
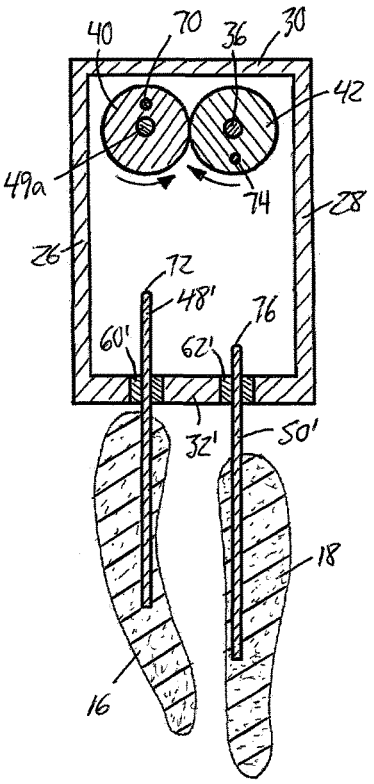
FIG. 6 is a cross-sectional view of a second embodiment clitoral stimulator, as viewed along line C-C of FIG. 8.
Figure 7:
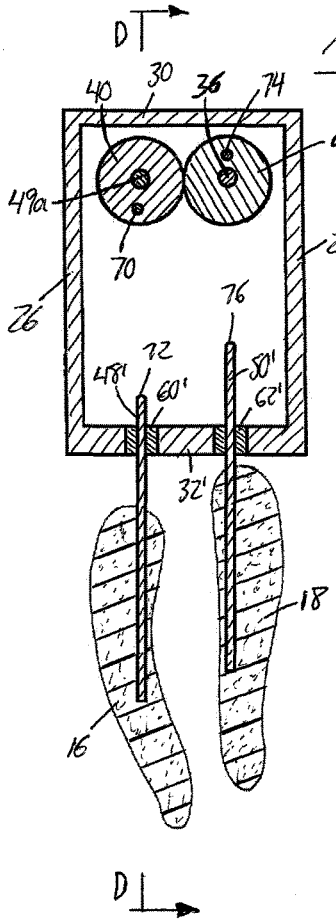
FIG. 7 is a cross-sectional view of the clitoral stimulator of FIG. 6, as viewed in the same plane, but with movable contact members of the stimulator in a different relative position to one another.
Figure 8:
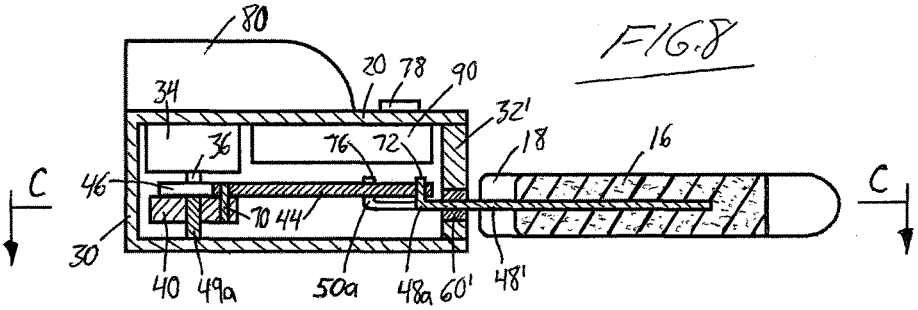
FIG. 8 is a cross-sectional view of the clitoral stimulator of FIG. 7, as viewed along line D-D thereof.

Whereas the first embodiment shown in FIGS. 1 through 5 features guide tracks defining channels in which flat plate-like carriers 48, 50 slide to reach through an open end of the housing and reciprocally carry the contact members 16 outside the housing, FIGS. 6 to 8 show a second embodiment in which the carriers are instead formed by rigid metal rods 52', 54' whose reciprocating linear motion is guided by a respective pair of bushings 60', 62' mounted in a second end wall 32' of the housing. Each carrier rod 52', 54' has a rigid, linearly extending cylindrical portion passing through the axial bore of a respective one of the guide bushings 60', 62', whereby the axial through-bore of each bushing constrains the respective carrier rod 48', 50' rod to linear motion along the bore's axis. Each carrier rod 48', 50' also has a bent end 48*a*, 50*a* that hooks though a bore in the end of the respective connecting rod 44 to establish the respective pivotal connection 72, 76 between the carrier and the connecting rod 44, 46.

The second embodiment also differs from the first in that the two drive wheels are in directly meshed relationship with one another, and the intermediate gear is therefore omitted. One of the drive wheels 42 is mounted on the motor shaft 36 for direct drive relationship with the motor. The two drive wheels are thus in counter-rotating relationship with one another in this direct-drive configuration. The indirect drive configuration of the first embodiment may benefit from a more balanced layout and feel due to central placement of the motor between the reciprocating components, while the second embodiment benefits from a reduced overall part count in the drive system. The omission of the guide tracks and reduction of the overall gear count in the drive system also enables use of a narrower housing for a more compact and comfortable hand-held design.

FIG. 8 also illustrates inclusion of a battery compartment 90 for holding one or more batteries for powering the motor. The illustrated battery compartment 90 is positioned at or near the interior side of the housing's top wall 20 for convenient wiring of the battery compartment between the motor 34 and the controls 78 that are mounted on the same top wall 20. The illustrated battery compartment is accessed by a charging port or removable cover at one of the side walls 28. However, it will be appreciated that the battery location may vary from this particular illustrated example. For example, in the direct-drive layout where the motor is aligned with one of the drive wheels at a position adjacent one of the housing's side walls, the battery compartment may be relocated to reside adjacent the opposing side wall so that the battery weight helps counteract the motor weight to impart a more balanced feel to the overall housing.

It will be appreciated that the described actuation mechanism employing a singular motor to drive a dual output gear train that converts the motor's rotational motion into reciprocating linear motion of the contact members may be substituted by other suitable mechanism for achieving relative motion between the two contact members in the longitudinal direction. Another embodiment could employ two motors to respectively rotate the drive wheels. In another embodiment, the device could employ one or two linear motors instead of covering rotational input from a rotary motor to linear reciprocating of the contact members. While the illustrated embodiment employs linear motion in the interest of mechanical simplicity, movement in the longitudinal direction is not limited to purely linear motion, and more complex motion may alternatively be employed to create suitable relative movement of the contact members to again achieve a rolling action on the clitoris.

While the illustrated embodiment drives both of the contact members, other embodiments could be configured to drive only one of the contact members, and to support the other in a fixed stationary position. However, two moving members may achieve better performance of the desired 'rolling' action on the clitoris between the two members.

In the illustrated embodiment, the contact members visually resemble human fingers, as best denoted in the overhead views of FIGS. 1 and 2, where the two contact members visually represent a thumb and index finger brought into close tip-to-tip proximity in a pinching-like action, where the curvier first contact member 16 resembles the bent index finger, while the straighter second contact member 18 resembles the thumb. While this design is modeled after a manually performed clitoris-rolling stimulation act performed between such a pinched together thumb and forefinger, it will be appreciated that the shape of the contact members may depart from that described and illustrated. In one such example, the described shape of the inner sides of the contact members may be retained, while the outer side profiles and/or widths of the contact members may depart from those shown without affecting the rolling-action performed on the clitoris at the contact surfaces at the inner sides of the contact members.

For ease of illustration, the first illustrated embodiment features a rectangular housing consisting of flat walls and a fully open end of the housing through which the reciprocal movement of the contact members is accommodated. However, in preferred embodiments, the housing is more ergonomically shaped for the comfort of the user, for example having a smoothly curved top wall of convex curvature sloping downward toward either end of the housing, similar to the topside of a conventional computer mouse to more comfortably conform to the palmar side of the user's hand. Optionally, the housing may feature other contoured walls in order to reduce the presence of sharp corners or edges and provide optimal comfort under contact of the housing with the user's body. Although not shown, a flexible boot or sheath is preferably fitted over the open end of the housing in a position enshrouding the drive ends of the contact members so as to completely close off the interior space of the housing. This prevents inadvertent pinching of the skin between the housing and the moving components, and seals off the housing interior, and the electrical components therein, from potential exposure to moisture. Preferably, the only openings in the flexible boot or sheath are a pair of holes through which the contact members reach toward their distal ends, with the movement of the contact members being accommodated, for example, by a sealed sliding interface between the contact members and the boot or sheath, or by an expandability and collapsibility of the boot or sheath in the longitudinal direction, whereby a distal end of the boot or sheath attached to the contact members in a sealed position therearound can move with the contact members.

While the first and second embodiments are described as having carriers of rigid structure, the carriers may alternatively be at least partially flexible or bendable. For example, the sliding part of the carrier constrained by the respective guide channels or bushing may be of rigid or substantially rigid character to preventing binding or jamming that might occur between the carrier and guide if the carrier were to bend or deflect from its cooperating shape slidable through the guide, while portions of the carrier that carry the contact members and reside outside the housing throughout the entirety of the drive stroke may have a shape-retaining but bendable character to enable selective adjustment of the relative positions and orientations of the two contact members, for example to adjust the spacing between the contact members to best fit a particular user. Accordingly, such adjustability may be provided by possession of such bendable shape-retaining character by either the carriers, the contact members, or both.

Since various modifications can be made in my invention as herein above described, and many apparently widely different embodiments of same made within the scope of the claims without departure from such scope, it is intended that all matter contained in the accompanying specification shall be interpreted as illustrative only and not in a limiting sense.

The invention claimed is:

1. A clitoral stimulator comprising:

first and second movable members, of which at least one of said first and second movable members is supported for back and forth movement relative to the other of said first and second movable members in a longitudinal direction, and each of which comprises a respective surface on an inner side thereof facing toward the other in a lateral direction lying transverse to the longitudinal direction, the respective surfaces being separated or separable by a sufficient distance to accommodate a user's clitoris between the respective surfaces of said first and second movable members;

at least one motor operably coupled to said at least one of said first and second movable members to drive said back and forth movement thereof; and a housing carrying said at least one motor and comprising a finger receptacle at a topside of said housing for wearing of the clitoral stimulator on a user's finger.

2. The clitoral stimulator of claim 1 wherein the actuation mechanism comprises one or more controls situated externally of the housing at the topside thereof at a location that is finger-tip accessible from the finger receptacle.

3. The clitoral stimulator of claim 2 wherein the finger receptacle is open ended and the one or more controls are located outside the finger receptacle at a location beyond an open end thereof.

4. A clitoral stimulator comprising:

first and second movable members, of which at least one of said first and second movable members is supported for back and forth movement relative to the other of said first and second movable members in a longitudinal direction, and each of which comprises a respective surface on an inner side thereof facing toward the other in a lateral direction lying transverse to the longitudinal direction, the respective surfaces being separated or separable by a sufficient distance to accommodate a user's clitoris between the respective surfaces of said first and second movable members;

at least one motor operably coupled to both the first and second movable members by an actuation mechanism to drive said back and forth movement, said actuation mechanism comprising:

a first driven wheel and first connecting rod for the first movable member, the first driven wheel being rotatable on a first rotation axis that is transverse to the longitudinal direction, the first connecting rod having a first pivotal connection to the first driven wheel at a first eccentric point thereon and a second pivotal connection to the first movable member, and the first and second pivotal connections of the first connecting rod having parallel pivot axes that lie transverse to the longitudinal direction; and a second driven wheel and second connecting rod for the second movable member, the second driven wheel being rotatable on a second rotation axis that is parallel to the first rotation axis of the first driven wheel, the second connecting rod having a third pivotal connection to the second driven wheel at a second eccentric point thereon and a fourth pivotal connection to the second movable member, and the second and third pivotal connections of the second connecting rod having third and fourth pivot axes that lie parallel to the pivot axes of the first and second pivotal connections.

5. The clitoral stimulator of claim 4 wherein the first and third pivotal connections reside diametrically opposite one another on the first and second driven wheels.

6. The clitoral stimulator of claim 4 wherein the at least one motor consists of a singular motor arranged to drive both of the first and second movable members, and each driven wheel is a geared drive wheel forming part of a gear train by which the singular motor drives both the first and second movable members.

7. A method of clitoral stimulation comprising:

obtaining a clitoral stimulator that comprises:

first and second movable members, of which at least one of said first and second movable members is supported for back and forth movement relative to the other of said first and second movable members in a longitudinal direction, and each of which comprises a respective surface on an inner side thereof facing toward the other in a lateral direction lying transverse to the longitudinal direction; and at least one motor operably coupled to said at least one of said first and second movable members to drive said back and forth movement thereof; and using the clitoral stimulator by receiving a user's clitoris between the respective surfaces of said first and second movable members, and activating the at least one motor to roll the user's clitoris between the movable members.

8. The method of claim 7 wherein both of the first and second movable members are supported for back and forth movement in the longitudinal direction and the at least one motor is configured to drive the first and second movable members in opposing directions in the longitudinal direction.

* * * * *